US005109742A

United States Patent [19]

Strong

[11] Patent Number: 5,109,742

[45] Date of Patent: May 5, 1992

[54] ATTACHMENT FOR MITER GAGE

[76] Inventor: Donald Strong, Rte. 1110, Whick, Ky. 41390

[21] Appl. No.: 660,146

[22] Filed: Feb. 22, 1991

[51] Int. Cl.[5] ..... B27B 25/10; B27B 27/08

[52] U.S. Cl. ..... 83/421; 83/425; 83/437; 83/468.7; 83/477.2; 83/700

[58] Field of Search ..... 83/468.3, 468.7, 419, 83/422, 437, 435.1, 477.2, 700, 581; 269/196, 229

[56] References Cited

U.S. PATENT DOCUMENTS

| | | | |
|---|---|---|---|
| 2,696,854 | 12/1954 | Woodruff | 83/437 |
| 2,710,633 | 6/1955 | Oberg | 83/437 |
| 2,884,965 | 5/1959 | Stahl | 83/468.3 X |
| 2,968,325 | 1/1961 | Wandvik | 83/437 |
| 4,165,668 | 8/1979 | McCord | 83/435.1 |
| 4,259,887 | 4/1981 | Dean | 83/437 |
| 4,454,793 | 6/1984 | Strong | 83/437 X |
| 4,658,686 | 4/1987 | Woods | 83/437 X |
| 4,741,387 | 5/1988 | Strong | 83/437 X |
| 5,018,562 | 5/1991 | Adams | 83/437 X |

*Primary Examiner*—Frank T. Yost
*Assistant Examiner*—Rinaldi Rada
*Attorney, Agent, or Firm*—Charles W. Chandler

[57] ABSTRACT

An attachment for a miter gage used on a table saw. The attachment includes two linear fences arranged at right angles to each other on a table surface. One of the fences is formed by an elongated channel member having a bottom wall, two side walls, and two inturned flanges. A manually-operable locking mechanism is mounted on and within the channel member to clamp the member in selected positions of adjustment at right angles to the other fence member.

6 Claims, 2 Drawing Sheets

ATTACHMENT FOR MITER GAGE

BACKGROUND AND SUMMARY OF THE INVENTION

This invention relates to an attachment for a miter gage used on a table saw. The invention is an improvement on structural arrangements shown in my prior U.S. Pat. Nos. 4,454,793 issued on Jun. 19, 1984, and 4,741,387 issued on May 3, 1988.

The above-mentioned patents show attachments for miter gages. In each case, the attachment includes an auxiliary fence of work-engageable stop unit positionable on a saw table at right angles to a main fence that is adjustably connected to a miter gage.

The present invention contemplates an auxiliary fence structure formed by a single channel member. The fence has a unitary one-piece structure with a desired rigidity and reasonable service life. The channel member side faces form continuous true linear, work-engagement surfaces.

A general object of the present invention is to provide a miter gage attachment that is an improvement on the attachments shown in my earlier U.S. Pat. Nos. 4,454,793 and 4,741,387. Improvements are generally in the areas of lower manufacturing cost, improved operational performance and lengthened service life. Another object is to provide an improved structure for quickly and conveniently locking the auxiliary fence to the main fence.

THE DRAWINGS

DESCRIPTION OF A PREFERRED EMBODIMENT OF THE INVENTION

Figure 1:
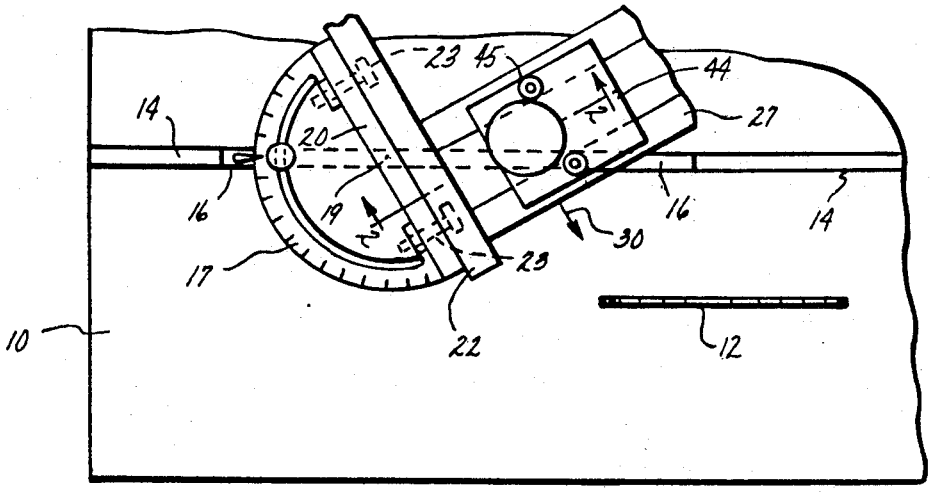
FIG. 1 is a top plan view of a table saw having a miter gage attachment illustrating the present invention installed thereon.

FIG. 1 is a top plan view of a saw table 10 having a motor-driven circular saw blade 12 projecting upwardly through the table surface to cut work pieces positioned thereon. FIG. 1 shows the projecting edge of the saw blade. A slot 14 is formed in the table surface to slidable accommodate an elongated bar 16. Miter gage 17 is swingably attached to bar 16 for arcuate adjustments around a vertical pivot axis 19 extending through the bar. The miter gage includes an upstanding plate 20 adapted to engage a workpiece positioned on the table surface. The miter gage is similar to the miter gage shown in my earlier U.S. Pat. Nos. 4,454,793 and 4,741,387.

The present invention is concerned with an attachment that includes a first elongated linear fence member 22 positionable against miter gage plate 20. Two square-headed bolts 23 extend from fence member 22 through apertures (grooves) in plate 20 to adjustably secure the fence member to the gage. The square heads of the two bolts are seated within a T-slot 24 running the length of the fence member. By loosening the associated nuts 25, it is possible to shift the fence member longitudinally to different positions on the miter gage.

A second elongated linear fence member 27 is positionable on table 10. An end face of member 27 abuts a longitudinal side surface of fence member 22. The second linear fence member is equipped with a manually-operable means for locking member 27 in selected positions of adjustment along the length of fence member 22. Numeral 30 indicates the direction of adjustment of member 27 along fence member 22.

Figure 3:
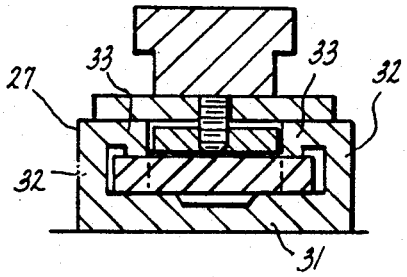
FIG. 3 is a transverse sectional view on line 3—3 in FIG. 2.

As seen in FIG. 3, fence member 27 is a channel member having a flat bottom wall 31, two upstanding side walls 32, and two inturned flanges 33. The channel member has a constant cross-section along its entire length. The ends of the channel member are open. Typically, this channel member has a length of about eight inches, a transverse width of about two and one-half inches, and a height of about one inch. Only about one-half of the channel member length is visible in FIG. 1. The channel member is preferably formed as an aluminum extrusion.

Figure 2:
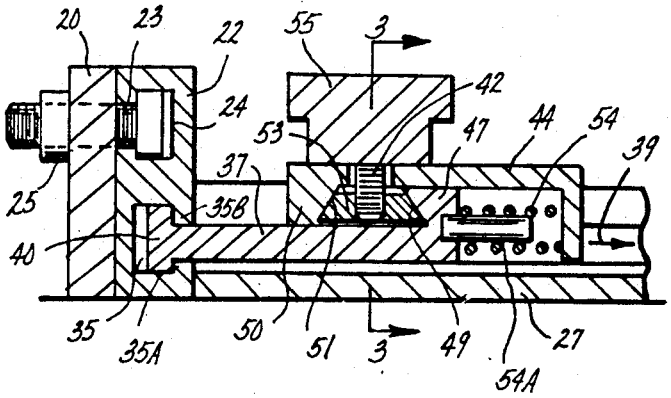
FIG. 2 is an enlarged fragmentary sectional view taken on line 2—2 in FIG. 1.

Referring to FIG. 2, the mechanism for locking fence member 27 to fence member 22 comprises a second T-slot 35 extending longitudinally within and along fence member 22 for its full length. Slot 35 has a pair of spaced lips 35A land 35B.

A slide element 37 is movably positioned within fence member 27 for movement in the direction of arrow 39. As seen in FIG. 3, the slide element has an upper surface engaged with inturned flanges 33, and a lower surface engaged with bottom wall 31. Slide element 37 is thereby restricted essentially to horizontal slidable motion in a lateral direction with respect to the length of T-slot 35.

Slide element 37 has a "T" cross-sectioned tongue 40 disposed in T-slot 35. With channel member 27 abutted against the side surface of member 22, an adjusting movement of slide element 37 in the arrow 39 direction will clamp lips 35A and 35B between tongue 40 and fence member 27 in a selected position of adjustment along fence member 22. The width of tongue 40, measured in the direction parallel to the length of T-slot 35 is the same as the width of slide element 37 to provide a fairly large clamping surface area.

Slide element 37 can be drawn to the right (in the arrow 39 direction) by a manual rotation of a vertical screw 42 that extends downwardly through a mounting panel 44. Two laterally-spaced screws 45 (FIG. 1) extend through panel 44 into channel flanges 33 to secure the panel in a fixed position on channel member 27.

Slide element 37 has an upstanding wall 47 between channel flanges 33. A cam face 49 of wall 47 generally facing fence member 22 and forming an acute angle with screw 42, forms a flat cam surface. A downwardly-extending wall portion 50 of panel 44 has a similarly angled cam surface 51 formed thereon but generally facing cam face 49.

Cam plate 53 has opposite edge areas acutely angled to facially engage flat cam surfaces 49 and 51. Screw 42 depends downwardly from an operating knob 55 through a threaded hole in cam plate 53. Manual rotation of knob 55 produces vertical motion of cam plate 53 and a horizontal motion of slide element 37. Slide element 37 moves either toward or away from fence member 22 depending upon the direction of rotation of knob 55, to either loosen or tighten tongue 40 in T-slot 35.

A coil spring 54 is mounted on pin 54A between slide element 37 and panel 44 to normally bias the tongue toward an unclamped condition except when knob 55 is rotated to bias slide element 37 toward its clamped position.

Figure 4:
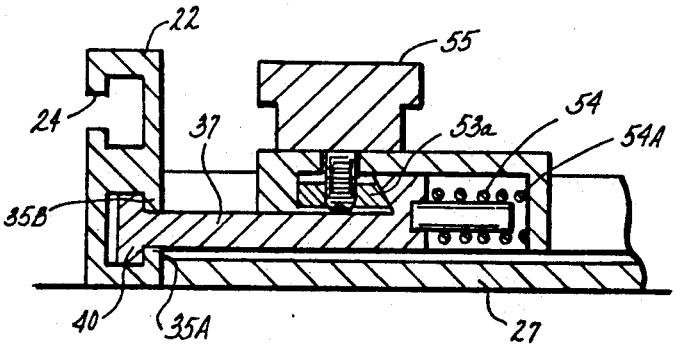
FIG. 4 is a fragmentary sectional view taken in the same direction as FIG. 2, but illustrating another embodiment of the invention.

FIG. 4 shows an alternative arrangement which includes a cam plate **53*a* having a single transverse cam surface. Slide element 37 has a cam surface, but panel 44 has no opposing cam surface. The general operation of the FIG. 4 structure is similar to that of FIG. 2**, except that the motions are somewhat slower (because of the fewer cam surfaces).

Figure 5:
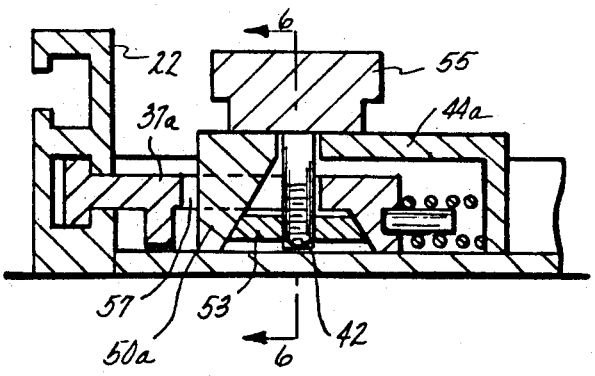
FIG. 5 is a fragmentary sectional view through another form of the invention.
Figure 6:
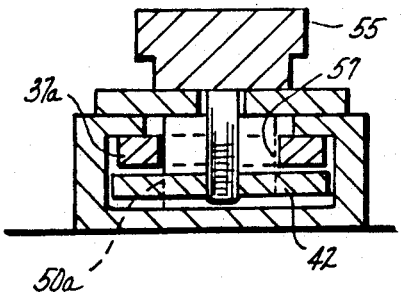
FIG. 6 is a transverse sectional view taken on line 6—6 in FIG. 5.

FIGS. 5 and 6 illustrate a variant of the cam mechanism used in the FIG. 2 embodiment. Cam plate 53 is located on the underside of slide element **37*a*. An elongated rectangular hole 57 is formed through the slide element to accommodate the downwardly-extending wall portion 50*a* of stationary panel 44*a*. As with the embodiments of FIGS. 2 and 4, the slide element is moved either to the left or to the right depending upon the direction of rotation of knob 55**.

Figure 7:
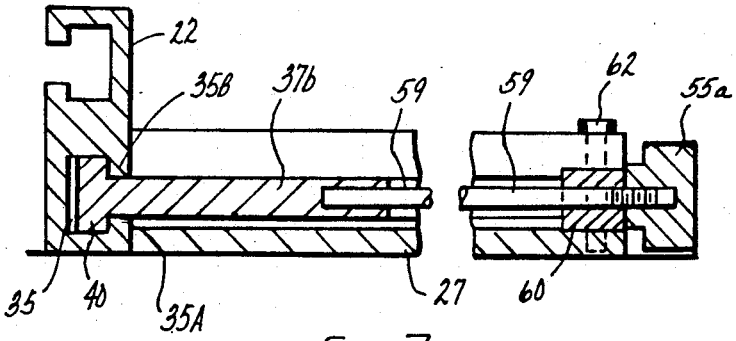
FIG. 7 is a longitudinal sectional view taken through a further embodiment of the invention.
Figure 8:
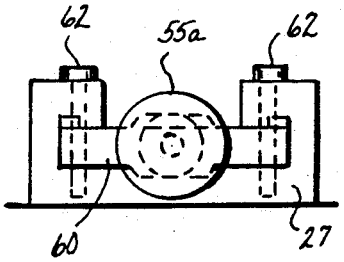
FIG. 8 is a right end view of the FIG. 7 structure.

FIGS. 7 and 8 show a further embodiment of the invention wherein a rod 59 extends from the right end of slide element **37*b* through a clearance hole in a fixed insert 60. Screws 62 mount the insert in a fixed position at the free end of a channel member 27. An internally threaded knob 55*a* is threaded onto a threaded end of rod 59 to abut against insert 60. Manual rotation of knob 55*a* is effective to draw slide element 37*b* to the right, thereby increasing the clamp force of tongue 40 on the lips 35A and 35B of T-slot 35. Reverse rotation of knob 55*a* releases the clamp force, thereby allowing member 27 to be adjusted along member 22**.

Figure 9:
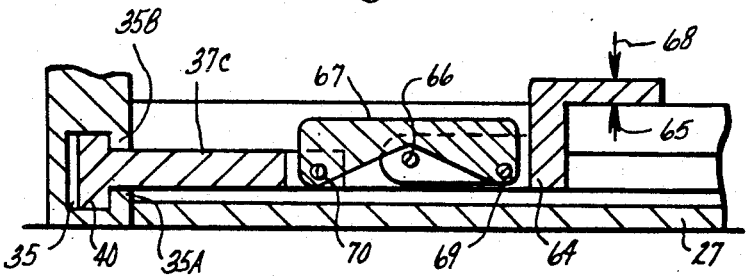
FIG. 9 is a longitudinal sectional view through an additional structure embodying the invention.
Figure 10:
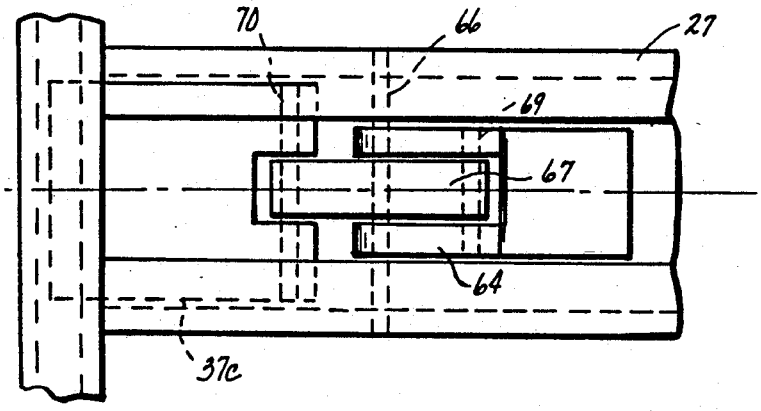
FIG. 10 is a plan view of the structure of FIG. 9.

FIGS. 9 and 10 illustrate an arrangement wherein slide element **37*c* is moved to a clamped condition by manual operation of a toggle mechanism. The toggle mechanism comprises a manual lever 64 having a swingable connection 66 with channel member 27. Intervening link 67 has its opposite ends pivotably connected to lever 64 and to slide element 37*c* via transverse rods 69 and 70**.

FIG. 9 shows the mechanism in the clamped condition wherein tongue 40 exerts a clamp action against the lips 35A and 35B of T-slot 35. Upward finger pressure on the underside of lever 64, as at 65, lifts the lever and permits link 67 to reduce the pulling force on slide element **37*c*. Lever 64 can be returned to its illustrated position by a downward manual force on lever 64, as at 68**.

The drawings show various types of manual locking mechanisms for adjustably retaining channel member 27 in selected positions of adjustment along the length of fence member 22. A principal feature of the invention is the channel-type construction of fence member 27. The fence member is formed by a single unitary channel element having continuous flat uninterrupted side walls 32 that can precisely position work pieces relative to saw blade 12. Miter joints can be formed without change in the fence member settings. Channel member 27 is a relatively low cost rigid structure that can have a relatively long service life.

Having described my invention, I claim:

1. An attachment for a miter gage that is arcuately adjustable on a table saw table; comprising a first elongated linear fence positionable on the table with a first longitudinal side surface thereof abutting against the miter gage; means for connecting said first fence in a selected longitudinal position along the miter gage; a second elongated linear fence positionable on the table, with one end of said second fence abutting against a second longitudinal side surface of the first fence; and means for locking said second fence in selected positions of adjustment along the length of the first fence; said second fence consisting of a single channel member extending right angularly from said first fence; said channel member having a flat bottom wall seatable on the table, two side walls extending upwardly from said bottom wall, and two inturned flanges extending from said side walls, each toward the other; said fence locking means comprising a T-slot having an internal wall and extending longitudinally within and along said first fence, a slide element movably positioned within the channel member, and a manually-actuable means for drawing said slide element along the channel member away from the first fence; said slide element having an upper surface thereof slidably engaged with the inturned flanges, and a lower surface thereof slidably engaged with the bottom wall of the channel member, whereby the slide element is restricted to horizontal motion within the channel member; said slide element having a T cross-sectioned tongue extending into said T-slot to exert a clamp action on the slot internal wall when the manually actuable means is operated.

2. The attachment of claim 1, wherein said slide element has at least one flat cam surface extending at an acute angle to a vertical plane passing through the slide element; said manually actuable means comprising a flat panel mounted on the channel member flanges, a flat-surfaced cam plate engaged with said flat cam surface below said panel, and a rotary screw extending downwardly through the panel into the cam plate whereby rotation of the screw produces a vertical motion of the cam plate and a horizontal motion of the slide element.

3. The attachment of claim 2, wherein said cam plate has a flat edge surface thereof slidably engaged with the slide element cam surface.

4. The attachment of claim 2, wherein said manually-actuable means further comprises a hand-engageable knob connected to said rotary screw above said panel.

5. The attachment of claim 2, wherein said cam plate extends across substantially the entire space between the channel member inturned flanges.

6. The attachment of claim 5, wherein the portion of the slide element that forms said flat cam surface is located between the inturned flanges on the channel member.

* * * * *